US007543770B2

(12) United States Patent
Peron et al.

(10) Patent No.: US 7,543,770 B2
(45) Date of Patent: Jun. 9, 2009

(54) AUTOMATED PILL CRUSHER

(75) Inventors: James Peron, North Tonawanda, NY (US); James Leahy, West Seneca, NY (US); Jonathan Leahy, West Seneca, NY (US); Robyn Washousky, Honolulu, HI (US)

(73) Assignee: The Research Foundation of State University of New York, Amherst, NY (US)

( * ) Notice: Subject to any disclaimer, the term of this patent is extended or adjusted under 35 U.S.C. 154(b) by 31 days.

(21) Appl. No.: 11/207,851

(22) Filed: Aug. 18, 2005

(65) Prior Publication Data

US 2006/0043225 A1 Mar. 2, 2006

Related U.S. Application Data

(60) Provisional application No. 60/603,009, filed on Aug. 20, 2004.

(51) Int. Cl.
*B02C 19/00* (2006.01)

(52) U.S. Cl. ..... 241/169; 241/169.1; 241/169.2; 241/270; 241/DIG. 27

(58) Field of Classification Search ..... 241/169.1, 241/169.2, 169, DIG. 27, 270
See application file for complete search history.

(56) References Cited

U.S. PATENT DOCUMENTS

| | | | | |
|---|---|---|---|---|
| 4,765,549 | A * | 8/1988 | Sherman | 241/169 |
| 6,357,679 | B1 * | 3/2002 | Radke | 241/30 |
| 6,508,424 | B1 | 1/2003 | Marshall | 241/169.1 |
| 6,622,949 | B1 | 9/2003 | Baswick et al. | 241/36 |
| 6,637,685 | B1 | 10/2003 | Kruger | 241/169.1 |
| 2006/0088422 | A1 * | 4/2006 | Hall et al. | 417/1 |

FOREIGN PATENT DOCUMENTS

| | | |
|---|---|---|
| CA | 2057245 | 12/1991 |
| CA | 2486472 | 11/2004 |

OTHER PUBLICATIONS

Occupational Health and Safety Agency for Healthcare in BC. (2003). "Pill Crusher and Medication Cart Update." Available at http://www.ohsah.bc.ca/media/Pill_Crusher_Med_Cart_PU.pdf.
T2 RERC Rehabilitation Engineering Research Center On Technology Transfer: Pill Crusher.

* cited by examiner

*Primary Examiner*—Mark Rosenbaum
(74) *Attorney, Agent, or Firm*—Simpson & Simpson, PLLC

(57) ABSTRACT

The present invention broadly comprises an automated pill crusher comprising a container operatively arranged to hold at least one pill, means for producing a linear force in a first direction upon at least one pill in the container, and, means for producing a spring force in a second direction upon at least one pill in the container. The pill crusher further comprises means for pulverizing at least one pill in the container.

12 Claims, 10 Drawing Sheets

AUTOMATED PILL CRUSHER

CROSS-REFERENCE TO RELATED APPLICATIONS

This application claims the benefit under 35 U.S.C. §119 (e) of U.S. Provisional Application No. 60/603,009, filed Aug. 20, 2004.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. H133E030025 awarded by the U.S. Department of Education (DoE).

FIELD OF THE INVENTION

The present invention relates generally to devices that crush pills and more particularly, to an automated pill crusher having a propelled ramming element that is urged against contained pills, crushing the pills into a powdered form

BACKGROUND OF THE INVENTION

Pill crushing is common in nursing homes, hospitals, and other types of long-term care facilities, and is performed by the medical staff. In the home, pills are often crushed by family members or by healthcare aides. Crushing is performed in a variety of locations and various devices are used. Some of the known devices and methods include using a Mortar and Pestle, a hammer, a razor, or an inverted spoon technique, all of which require manually pressing pills into a powdered form. A problem with manually crushing pills is that it requires physical strength and some techniques are unsafe, such as using a hammer or razor blade. Further, manually crushing several pills a day can cause repetitive motion injuries, such as carpal tunnel syndrome. Another problem is that it is difficult to recover the entire medication dosage since the pill is not contained when crushed.

Others have addressed the problem of crushing pills manually. U.S. Pat. No. 6,622,949 (Baswick et al.) discloses a portable pill crusher having a solenoid and cup assembly. A problem with this invention is that the solenoid produces a startling, loud bang when crushing pills. Further, there is no biasing spring to force the cups in an upward direction after crushing. Another problem with this design is that it does not have a pulverizing attachment to prevent the pills from being re-compacted by the force of the ram head. What is needed then is a device for allowing one to crush pills more safely and easily, while still recovering the full dose in a powdered form.

SUMMARY OF THE INVENTION

The present invention broadly comprises an automated pill crusher comprising a container operatively arranged to hold at least one pill, means for producing a linear force in a first direction upon at least one pill in the container, and, means for producing a spring force in a second direction upon at least one pill in the container. The pill crusher further comprises means for pulverizing at least one pill in the container.

An advantage of the invention is that the pill-crushing device comprises means for automatically actuating a ramming element with enough force to crush a pill into a powdered form.

Another advantage of the invention is that the pill-crushing device comprises a container having a biasing spring to prevent a cup from being lodged in the container as a result of the ramming element force.

Yet another advantage of the invention is that the pill-crusher comprises a pulverizing attachment to prevent the crushed pill from being re-compacted by the force of the ramming element.

A further advantage of the invention is to provide a device that is small and operates quietly when crushing pills.

These and other advantages, features, and objects of the present invention will become readily apparent to those having ordinary skill in the art upon reading the following detailed description of the invention in view of the several drawing figures and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments.

Furthermore, it is to be understood that this invention is not limited to the particular methodology, materials and modifications described as such may, of course, vary. It is also to be understood that the terminology used herein is for the purpose of describing particular embodiments only, and is not intended to limit the scope of the present invention, which will be limited only by the appended claims.

Figure 1:
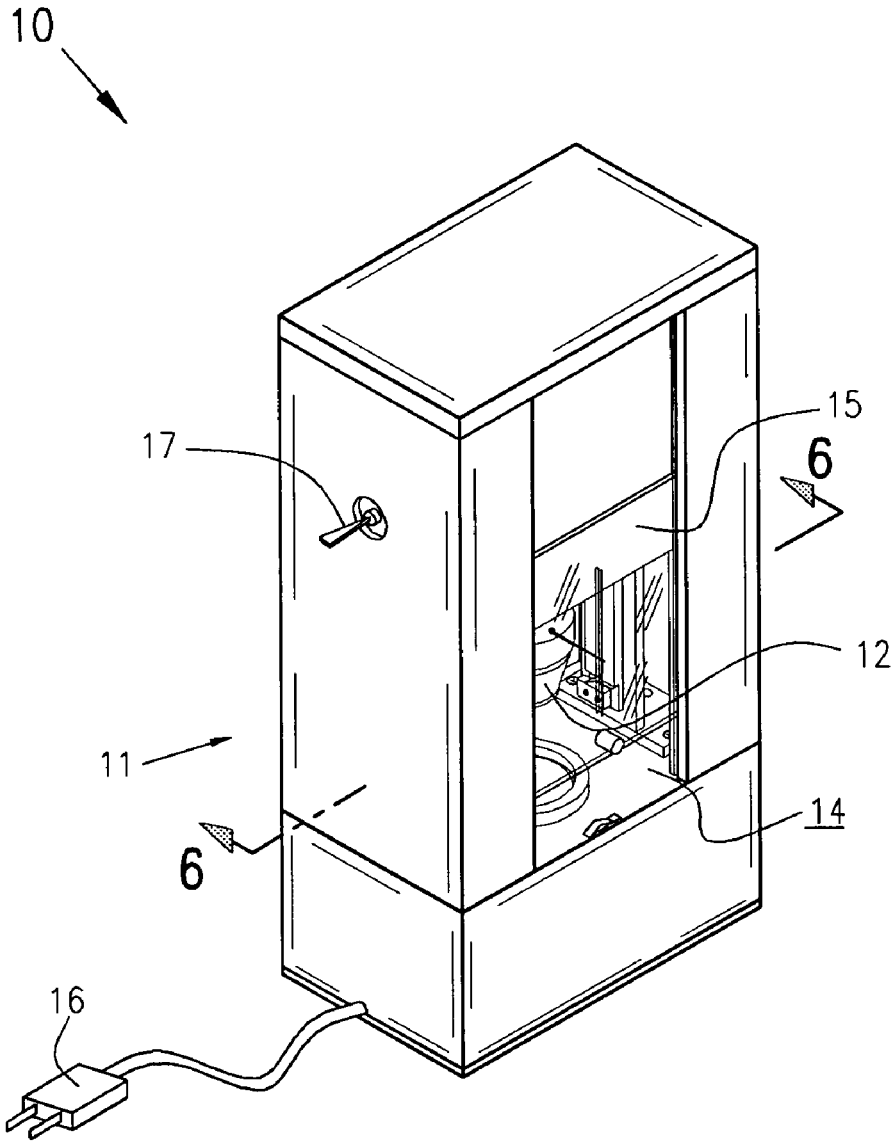
FIG. 1 is a perspective view of a present invention pill crusher.

Adverting to the drawings, FIG. 1 is a perspective view of present invention pill crusher 10. Pill crusher 10 broadly comprises outer housing 11, ramming element 12, and linear actuator 13 (shown in FIG. 2). Linear actuator 13 produces a linear force in a first direction upon at least one pill. By "linear force," it is meant that a force is applied substantially along a line, rather than along an arc. For example, a pivoting mechanism, where an actuator moves along an arc, is not a linear force. Housing 11 further comprises opening 14 with access door 15 that slideably moves upward and downward. Although a plexiglass door is shown, it should be appreciated by those having ordinary skill in the art, that other materials are contemplated. In some aspects, pill crusher 10 comprises electrical plug 16. However, it should be appreciated that it is possible to construct pill crusher 10 with a different power source. For example, pill crusher 10 could be powered by at least one rechargeable battery. Therefore, pill crusher 10 can be portable and operatively arranged to be easily operated on a medicine cart and the like. Further, the rechargeable battery may utilize a docking station for recharging. Housing 11 also comprises on/off switch 17. As discussed in more detail infra, when switch 17 is pressed down, linear actuator 13 propels ramming element 12 in a downwardly direction urging ramming element 12 against contained pills and thereby crushing the pills into a powdered form When switch 17 is pressed up, ramming element 12 actuates in an upward direction. It should be appreciated to those having ordinary skill in the art, however, that other on/off switches may be used, for example a large or small push button, and these modifications are intended to be within the scope of the invention as claimed.

Figure 2:
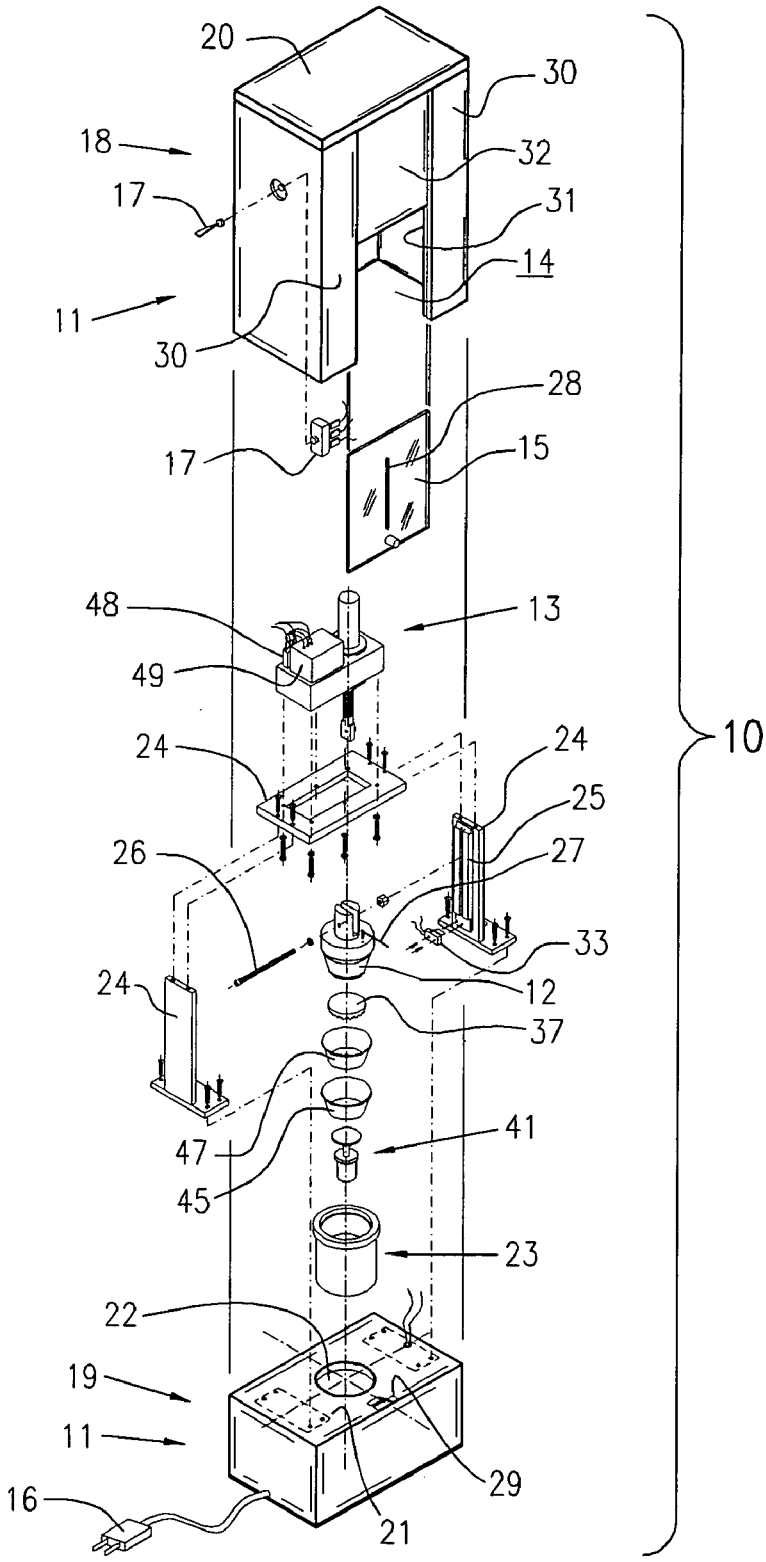
FIG. 2 is an exploded view of a present invention pill crusher.

FIG. 2 is an exploded view of present invention pill crusher 10. In some aspects, outer housing 11 comprises upper case 18, lower base 19, and top panel 20. Lower base 19 further comprises platform 21 having aperture 22 for container 23 to rest therein. Ramming element 12 is fixedly secured to linear actuator 13 and is operatively aligned with container 23. Container 23 is operatively arranged to receive ramming element 12 when linear actuator 13 propels ramming element 12 in a downwardly direction. Ramming element 12 is further described in more detail infra. In some aspects, linear actuator 13 is fixedly secured to aluminum chassis 24, which is fixedly secured atop platform 21. Attached to side of chassis 24 is guide track 25 that engages arm 26, extending outwardly from ramming element 12. Guide track 25 is operatively positioned to align ramming element 12 with container 23. Pin 27 engages slot 28 in access door 15. It should be appreciated by those having ordinary skill in the art that while an aluminum chassis is used, other support systems are contemplated including, but not limited to shelves, brackets, bolts, etc. It should also be appreciated that other materials are contemplated including wood, plastic, and other metals and these modifications are intended to be within the scope of the invention as claimed. Limit switch 29 is positioned on lower base 19 and is operatively arranged such that switch 29 is pushed downward by access door 15 when access door 15 is completely closed, thereby closing the circuit and allowing current to flow as discussed in more detail infra. Thus, as a safety feature, pill crusher 10 may be activated only when access door 15 is closed. It should be understood that other safety mechanism switches are included within the spirit and scope of the claims. Front of upper case 18 generally comprises side panels 30 with grooved slots 31, and center panel 32. Opening 14 is formed between side panels 30 with grooved slots 31 and center panel 32, wherein access door 15 is operatively arranged to slide therein. A second limit switch 33 is position at the bottom of guide track 25. Switch 33 is pressed down by arm 26 when ramming element 12 reaches a predetermined lowest position. By "predetermined lowest position," it is meant that ramming element is stopped and cannot proceed further downward as described in more detail infra. Ramming element 12 may therefore, only move upward when switch 33 is in a downward position. Switch 33 thereby prevents linear actuator 13 from self-destructing pill crusher 10 by the force exerted by ramming element 12 coupled to linear actuator 13. It should be apparent that a plurality of switches may be used and these modifications are intended to be within the spirit and scope of the invention as claimed.

Figure 3:
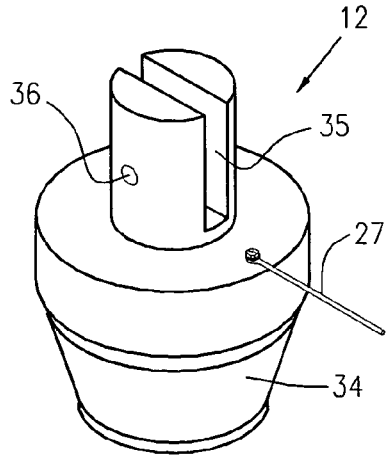
FIG. 3 is a perspective view of the ramming element of a present invention pill crusher of FIG. 1.

FIG. 3 is a perspective view of ramming element 12 of present invention pill crusher 10 of FIG. 1. Ramming element 12 comprises frusto-conical shaped head 34, neck 35, and pin 27 extending outwardly from ramming element 12. The frusto-conical shaped head 34 of ramming element 12 is operatively arranged to fit snugly into a two-ounce cup having an inverted frusto-conical shape. However, it should be appreciated that other ramming element shapes and sizes are contemplated. Neck 35 is U-shaped having two sidewalls with two corresponding apertures 36. Arm 26 (shown in FIG. 2) traverses apertures 36 of ramming element neck 35, and is operatively arranged to connect ramming element 12 to linear actuator 13. Although arm 26 comprises a screw, it should be readily apparent to one skilled in the art that other materials are contemplated, including but not limited to, a bolt or a wooden, plastic or metal dowel.

Figure 4A:
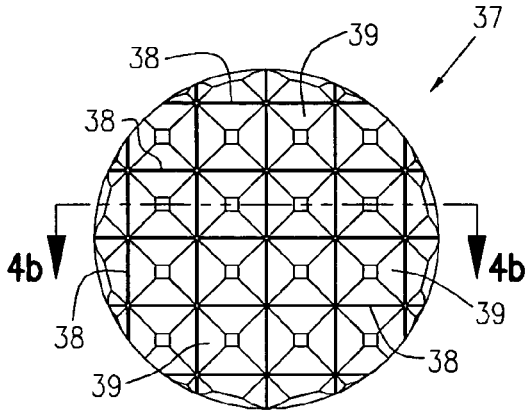
FIG. 4*a* is a bottom view of the pulverizing attachment of a present invention pill crusher of FIG. 1.

FIG. 4*a* is a bottom view of pulverizing attachment 37 of present invention pill crusher 10 of FIG. 1. Pulverizing attachment 37 comprises a plurality of ridges 38 and a plurality of pyramids 39. In some aspects, ridges 38 comprise a plurality of first ridges, disposed parallel to one another, extending in a first direction, and a plurality of second ridges, disposed parallel to one another, and extending in a second direction perpendicular to a first direction. Pulverizing attachment 37 may comprise means for pulverizing at least one pill crush in container 23.

Figure 4B:
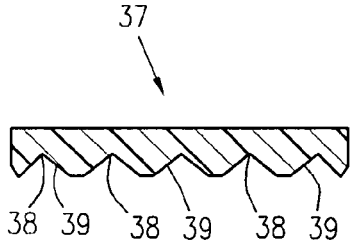
FIG. 4*b* is a cross-sectional view of the pulverizing attachment of a present invention pill crusher of FIG. 1, taken generally along line 4*b*-4*b* in FIG. 4*a;*

FIG. 4*b* is a cross-sectional view of pulverizing attachment 37 of present invention pill crusher 10 of FIG. 1, taken generally along line 4*b*-4*b* in FIG. 4*a*. Ridges 38 and pyramids 39 are operatively arranged to prevent the crushed pills from being re-compacted by the force of ramming element 12. In some aspects, pulverizing attachment 37 is made of plastic and has a diameter that is identical or similar in size to the bottom surface of ramming head 34. It should be appreciated, however, that attachment 37 can be made of other materials such as chrome, stainless steel, brass, etc. or wood, and could be permanently affixed to head 34.

Figure 5A:
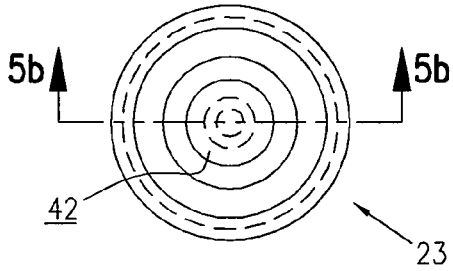
FIG. 5*a* is a top view of the container of a present invention pill crusher of FIG. 1.

FIG. 5*a* is a top view of the container 23 of present invention pill crusher 10 of FIG. 1.

Figure 5B:
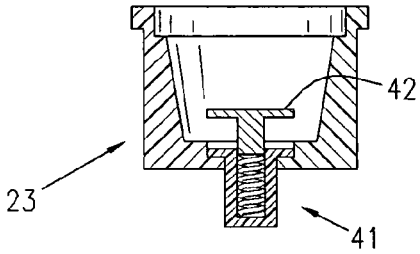
FIG. 5*b* is a cross-sectional view of the container and biasing spring mechanism of a present invention pill crusher, taken generally along line 5*b*-5*b* in FIG. 5*a;*

FIG. 5*b* is a cross-sectional view of container 23 and biasing spring mechanism 41 of present invention pill crusher 10 of FIG. 1, taken generally along line 5*b*-5*b* in FIG. 5*a*.

Figure 5C:
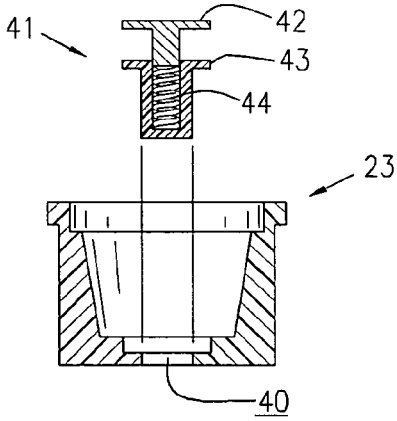
FIG. 5*c* is an exploded cross-sectional view of the container and biasing spring of a present invention pill crusher of FIG. 1, taken generally along line 5*b*-5*b* in FIG. 5*a;*

FIG. 5*c* is an exploded cross-sectional view of container 23 and biasing spring mechanism 41 of present invention pill crusher 10 of FIG. 1, taken generally along line 5*b*-5*b* in FIG. 5*a*. The following should be viewed in light of FIGS. 5*a*, 5*b*, and 5*c*. Container 23 is operatively arranged to hold at least one pill, wherein the at least one pill may be contained inside an inverted frusto-conical shaped cup. Container 23 comprises aperture 40 wherein biasing spring mechanism 41 is operatively arranged therein. Biasing spring mechanisms 41 comprises means for producing a spring force in a second direction upon at least one pill in container 23. The bias force provided by biasing spring mechanism 41 raises at least one souffle cup upwards after at least one pill is crushed, thereby preventing the cup(s) from being lodged in container 23 by the force of ramming element 12 (shown in FIG. 2) being propelled by linear actuator 13 (shown in FIG. 2). Although container 23 is designed to hold at least one two-ounce medicine cup, is should be appreciated that container 23 could be designed to hold other cup sizes. Biasing spring mechanism 41 is positioned through aperture 40 of container 23. Spring mechanism generally comprises disk 42 for holding at least one cup, flange 43, and spring 44. Flange 43 engages aperture 40 of container 23 to inhibit spring mechanism 41 from sliding therein. Spring 44 should exert enough force to raise at least two ounces from a down position.

Figure 6A:
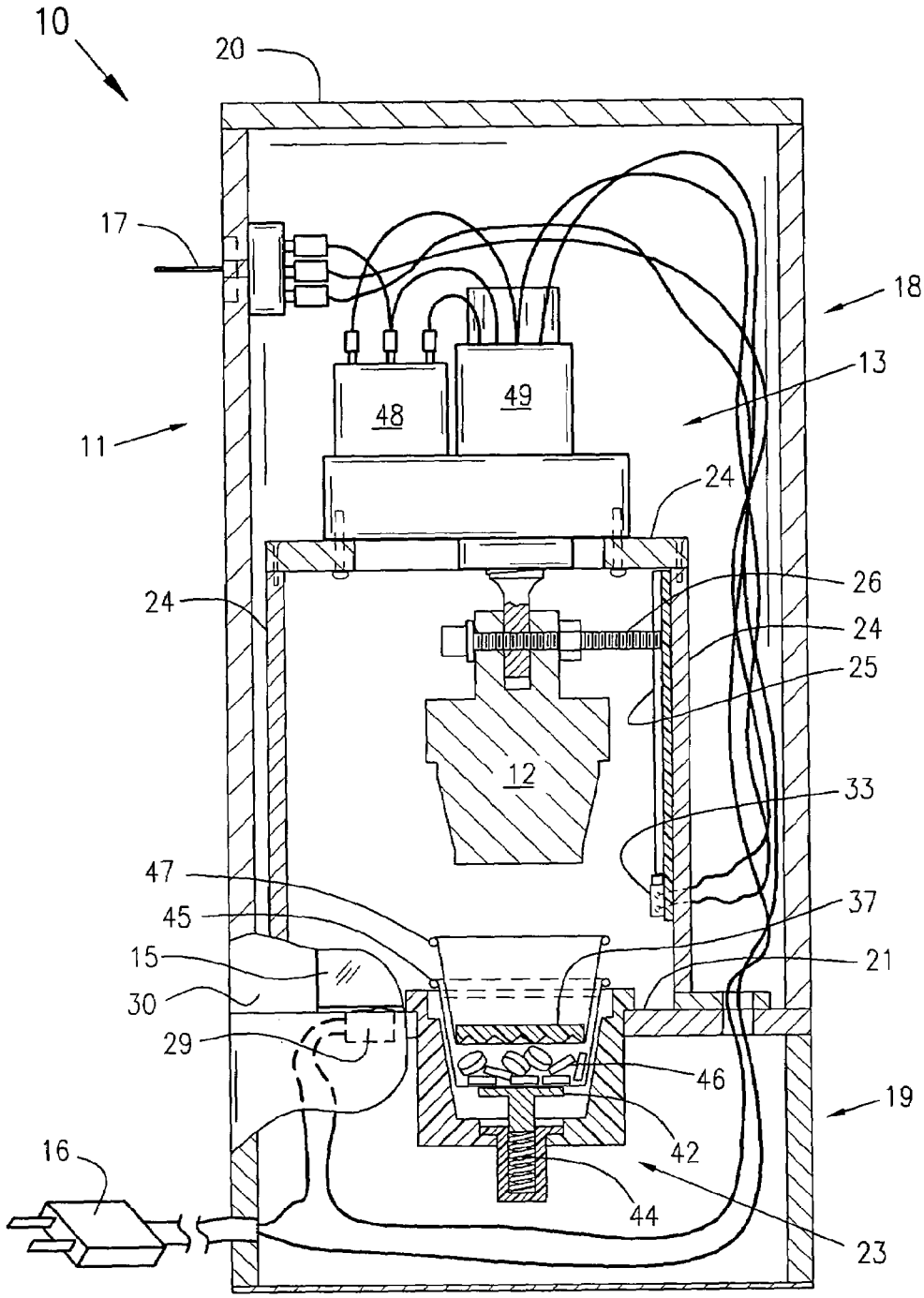
FIG. 6*a* is a partial cross-sectional view of a present invention pill crusher taken generally along line 6-6 in FIG. 1.

FIG. 6*a* is a partial cross-sectional view of present invention pill crusher 10 taken generally along line 6-6 in FIG. 1. In a preferred embodiment, switch 29 is centrally located on lower base 19 as shown in FIG. 1. However, in FIGS. 6*a*, 6*b*, 6*c*, and 6*d*, switch 29 is shown on the left side of lower base 19 to clearly illustrate the wiring of switch 29. In some aspects, a two-cup technique is used to crush pills to prevent cross-contamination of medications from the powder residue that could stick to ramming element 12. First, souffle cup 45, having an inverted frusto-conical shape, is placed in container 23, wherein cup is resting on unengaged spring disk 42. Attachment 37 is placed in a second cup 47, having an inverted frusto-conical shape, such that pulverizing ridges 38 and pyramids 39 (shown in FIG. 4*a*) are placed on the bottom of cup 47. Second cup 47 with attachment 37 is placed inside first cup 45 containing pills 46. Cups 45, 47 rest in container 23 of pill crusher 10. The two-cup technique, wherein the pills are positioned between two cups, reduces the amount of dosage lost during the crushing process. It should be appreciated by those having ordinary skill in the art that while the attachment was placed in a second cup, the attachment can be fixedly secured to the ramming head and this modification is intended to be included within the scope of the invention as claimed.

Figure 6B:
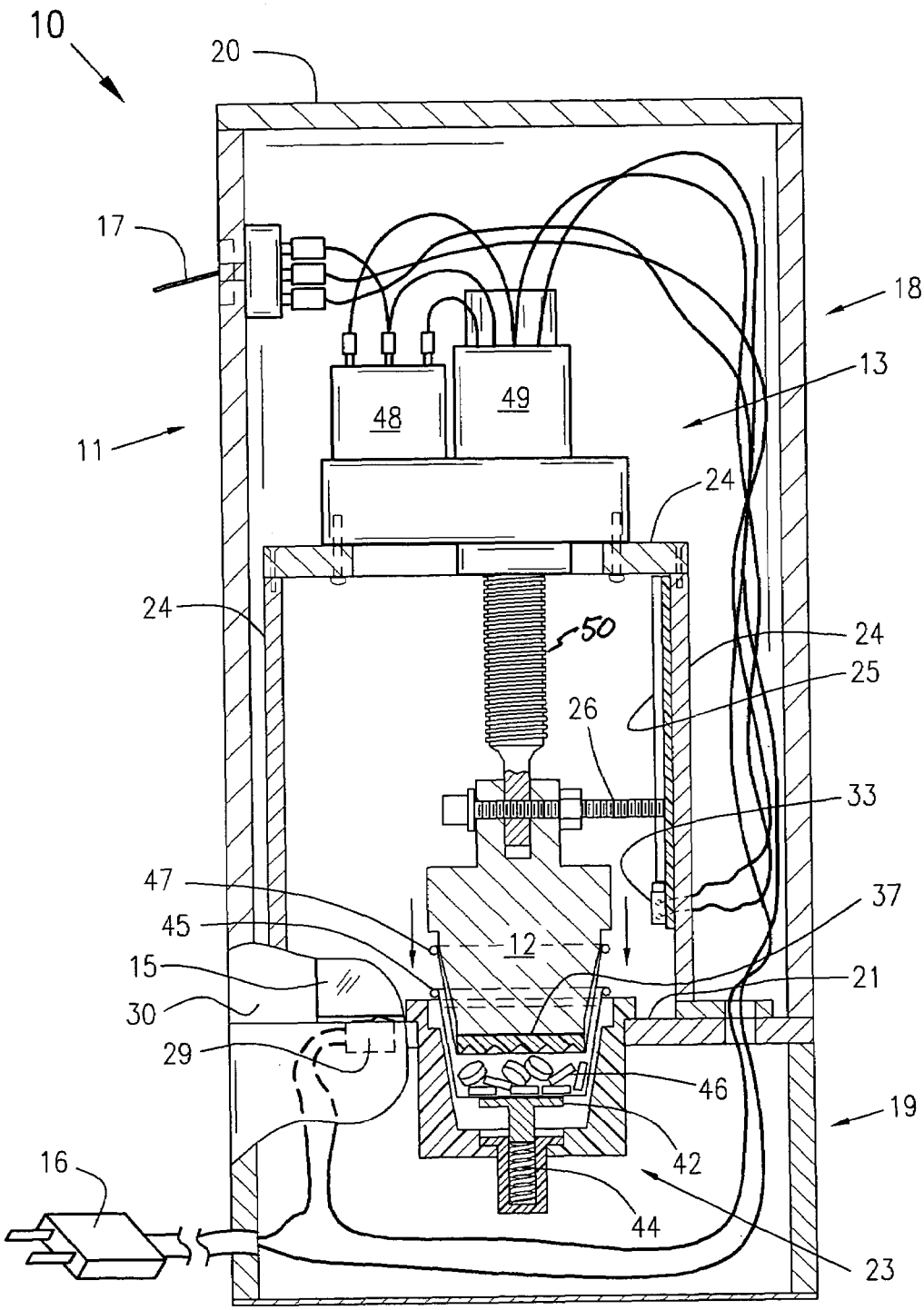
FIG. 6*b* is a partial cross-sectional view of a present invention pill crusher taken generally along line 6-6 in FIG. 1, showing ramming element actuating in a downward direction.

FIG. 6*b* is a partial cross-sectional view of present invention pill crusher 10 taken generally along line 6-6 in FIG. 1, showing ramming element 12 actuated in a downwardly direction. Ramming element 12 is operatively arranged to fit tightly into second cup 47 having pulverizing attachment 37.

Figure 6C:
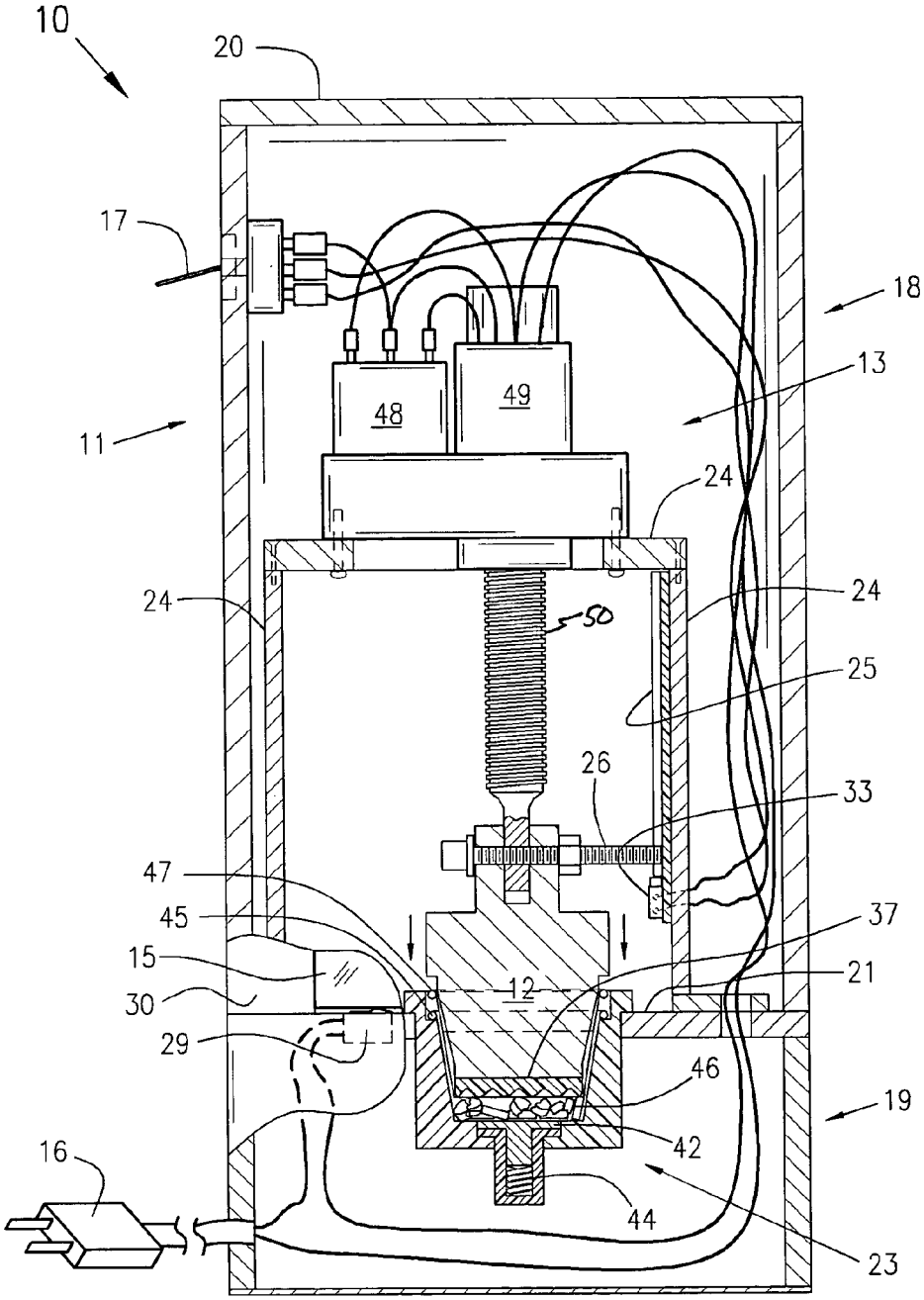
FIG. 6*c* is a partial cross-sectional view of a present invention pill crusher taken generally along line 6-6 in FIG. 1, showing pills being crushed.

FIG. 6*c* is a partial cross-sectional view of present invention pill crusher 10 taken generally along line 6-6 in FIG. 1, showing pills 46 being crushed. As the downwardly force from the ramming element 12 coupled to linear actuator 13 increases, cups 45 and 47, disk 42, and spring 44 are pushed downward until disk 42 is flush with the bottom of container 23. Pills 46 positioned between first cup 45 and second cup 47 begin to be crushed into a powder form by the force of ramming element 12.

Figure 6D:
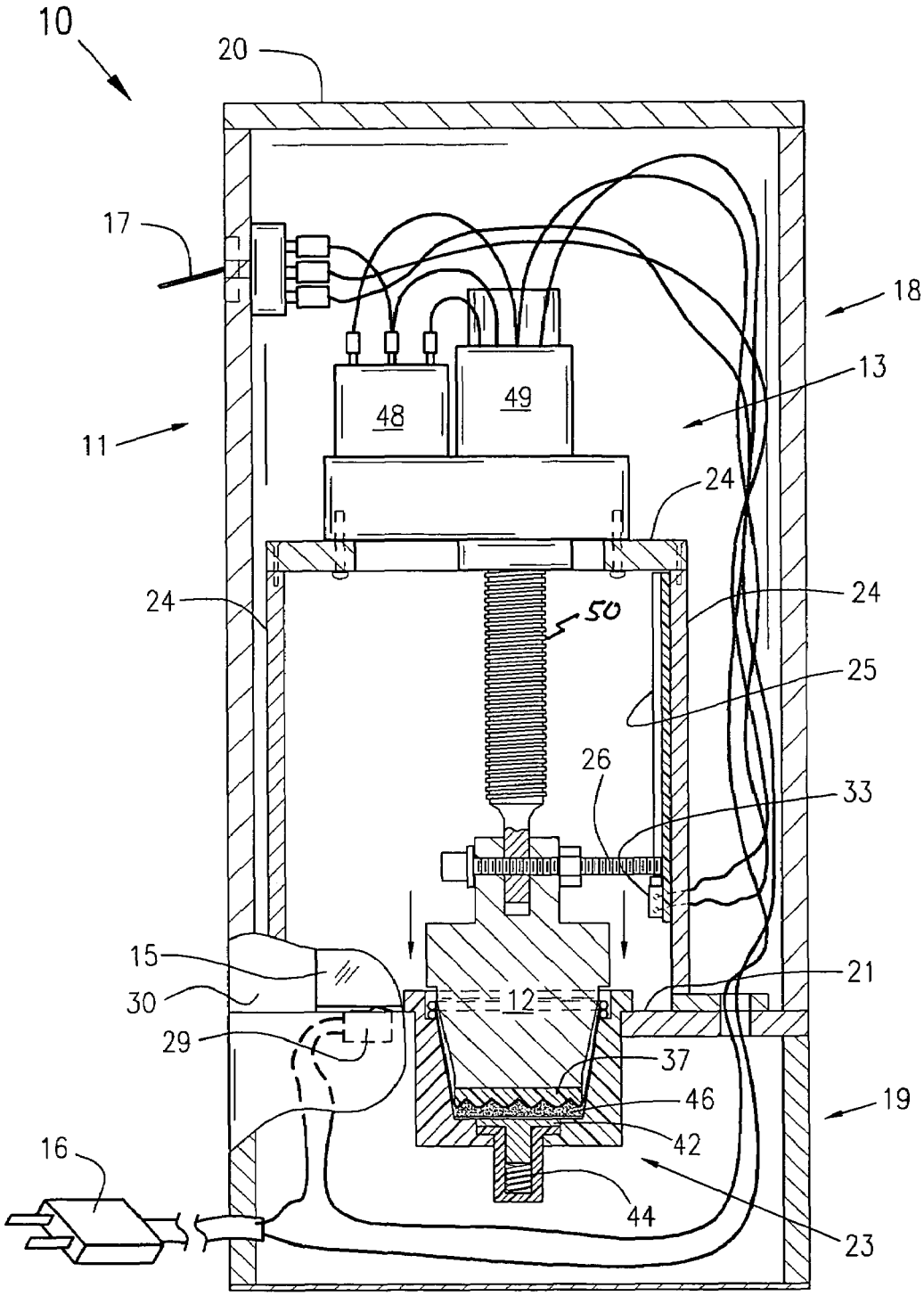
FIG. 6*d* is a partial cross-sectional view of a present invention pill crusher taken generally along line 6-6 in FIG. 1, showing pills that have been crushed into a powder form.

FIG. 6*d* is a partial cross-sectional view of present invention pill crusher 10 taken generally along line 6-6 in FIG. 1, showing pills 46 that have been crushed into a powder form Pulverizing attachment 37 prevents pills 46 from being re-compacted into pill form As explained in more detail infra, ramming element stops moving in a downward direction when arm 26 engages switch 33. Linear actuator 13 is strong enough to crush a plurality of pills but makes very little noise when operating. In a preferred embodiment, a 120 Volt AC/60 Hz/1.5 amp linear actuator is utilized having a 2⅝-inch stroke length and a worm gear that rotates at 34 rpm In the embodiment shown, linear actuator 13 was manufactured by the Hepa Company and purchased at www.surpluscenter.com, Item # 5-1463. Linear actuator 13 exerts almost 900 pounds of force, but a smaller linear actuator exerting less force may be used. Linear actuator 13 further comprises electrical connector 48 and motor 49 (shown in FIG. 8*a*). In a preferred embodiment, motor 49 is located directly in front of electrical connector 48 as shown in FIG. 2. However, in FIGS. 6*a*, 6*b*, 6*c*, and 6*d*, motor 49 is shown on the right side of linear actuator 13 to clearly illustrate the wiring of motor 49. Means for producing a linear force in a first direction upon at least one pill in a container may comprise linear actuator 13. Although, it should be readily apparent to one skilled in the art that other means of propelling a ramming element are possible, including but not limited to a rotary or motorized actuator, and these are intended to be within the spirit and scope of the invention as claimed.

Figure 7A:
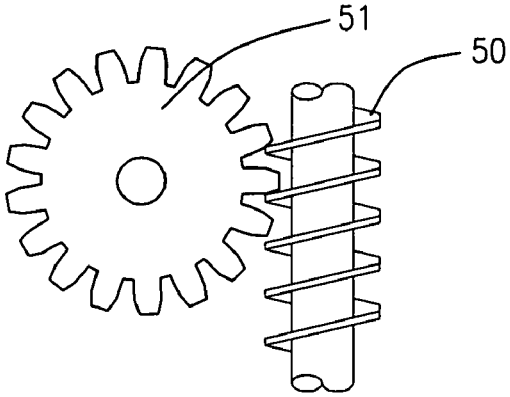
FIG. 7*a* is a plan view of a worm gearing of the linear actuator of the pill crusher.

FIG. 7*a* is a plan view of a worm gearing of linear actuator 13 of present invention pill crusher 10. In this embodiment, linear actuator 13 comprises wormgear 51 and worm 50, which makes very little noise when operating.

Figure 7B:
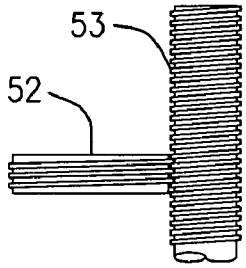
FIG. 7*b* is a plan view of an alternative embodiment of a worm gearing of the linear actuator of the pill crusher.

FIG. 7*b* is a plan view of an alternative embodiment of a worm gearing of linear actuator 13 of present invention pill crusher 10. In this embodiment, linear actuator 13 comprises worm gear 52, electrical connector 48, motor 49, and vertical reciprocal shaft 53. Motor 49 drives worm gear 52, which causes shaft 53 to actuate in an upward and downward direction.

Figure 8A:
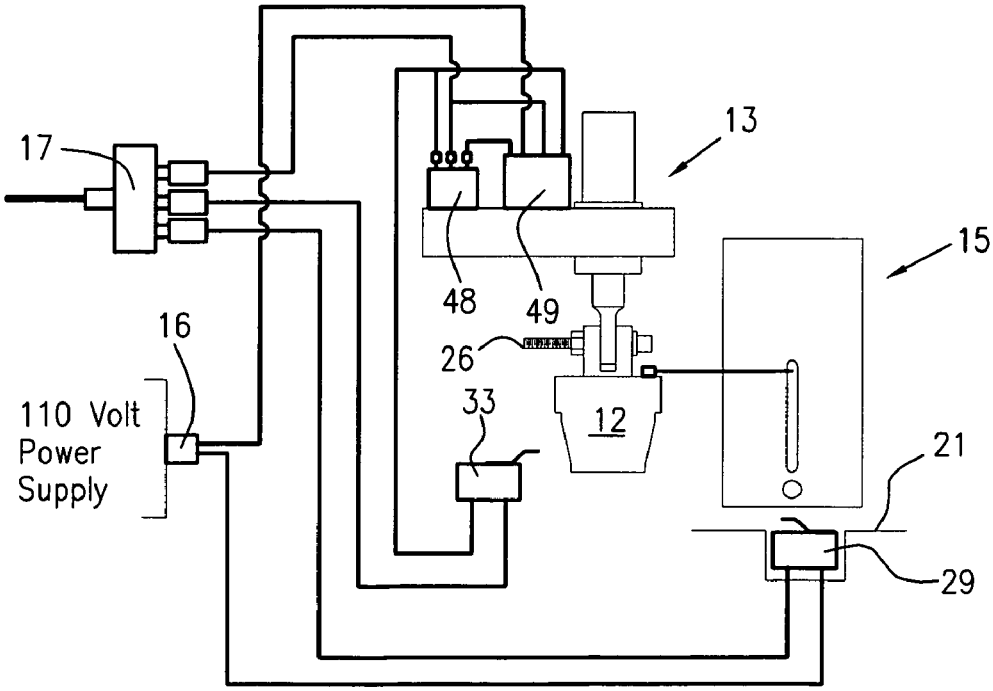
FIG. 8*a* is a schematic drawing illustrating the electrical circuit of a present invention pill crusher of FIG. 1, showing limit switch in an upward position and limit switch in an upward position.

FIG. 8*a* is a schematic drawing illustrating the electrical circuit of present invention pill crusher 10 of FIG. 1, showing first limit switch 29 in an upward position and second limit switch 33 in an upward position. It should be appreciated by one having ordinary skill in the art that the upward/disengaged position or downward/engaged position of the switches do not correlate to whether the circuit is open or closed. Hereinafter, the terms upward position and disengaged position are used interchangeably and the terms downward position and engaged position are used interchangeable. Switch 29 in an upward position opens part of the circuit and prohibits current flow, while switch 33 in a downward position opens part of the circuit and prohibits current flow. Limit switch 29 is located on the edge of lower base 19 (shown in FIG. 2) and is in an upward position when access door 15 is open. Thus, current is not permitted to flow through the circuit when limit switch 29 is disengaged because the circuit is open. Switch 29 is a safety feature preventing a user from injuring their hand or fingers by the force of ramming element 12 being propelled downward by linear actuator 13. When switch 33 remains in an upward position, that part of the circuit remains closed as described in more detail infra. As shown in the Figure, linear actuator 13 further comprises electrical connector 48 and motor 49.

Figure 8B:
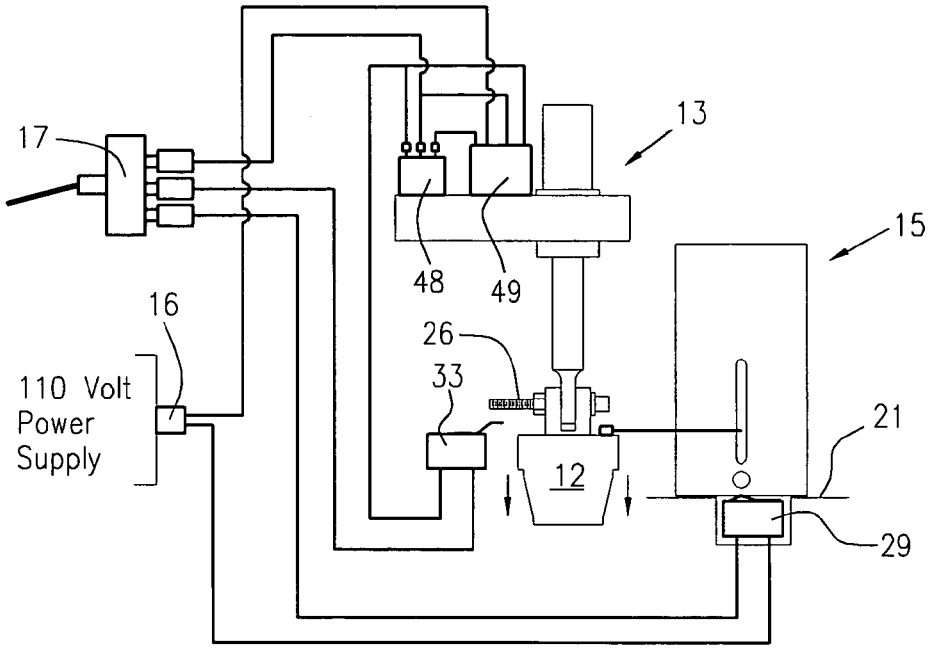
FIG. 8*b* is a schematic drawing illustrating the electrical circuit of a present invention pill crusher of FIG. 1, showing limit switch in a downward position and limit switch in an upward position.

FIG. 8*b* is a schematic drawing illustrating the electrical circuit of present invention pill crusher 10 of FIG. 1, showing limit switch 29 in a downward or an engaged position and limit switch 33 is in an upward, or disengaged position. Access door 15 is closed thereby pressing limit switch 29 down. Having switch 29 in a downward position and switch 33 in an upward position allows current to flow through the circuit so that the pill crusher 10 will operate. Therefore, when on/off switch 17 is pressed downward, ramming element 12 operatively coupled to linear actuator 13 is permitted to move in a downwardly direction as shown in the Figure. In some aspects, switch 17 is a double pole-double throw-center off switch. However, switch 17 may be a single pole-double throw-center off switch or a large push button switch.

Figure 8C:
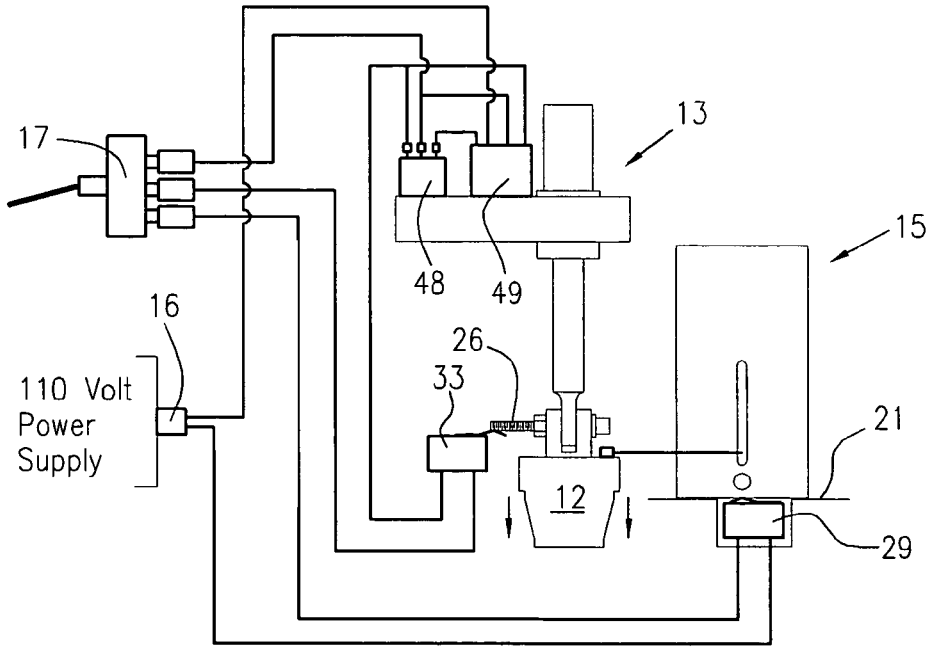
FIG. 8*c* is a schematic drawing illustrating the electrical circuit of a present invention pill crusher of FIG. 1, showing both limit switch and limit switch in a downward position.

FIG. 8*c* is a schematic drawing illustrating the electrical circuit of present invention pill crusher 10 of FIG. 1, showing both limit switch 29 and limit switch 33 in a downward position. Here, ramming element 12 has reached a predetermined lowest position and the ramming element 12 is automatically stopped, since arm 26 has engaged switch 33. The circuit is therefore open, and current flow is prevented. This prevents ramming element 12 from being further actuated in a downward direction by linear actuator 13 and pill crusher 10 (shown in FIG. 1) is prevented from self-destructing. Switch 17 may be pressed in an upward direction and ramming element 12 is then actuated upwardly as explained infra.

Figure 8D:
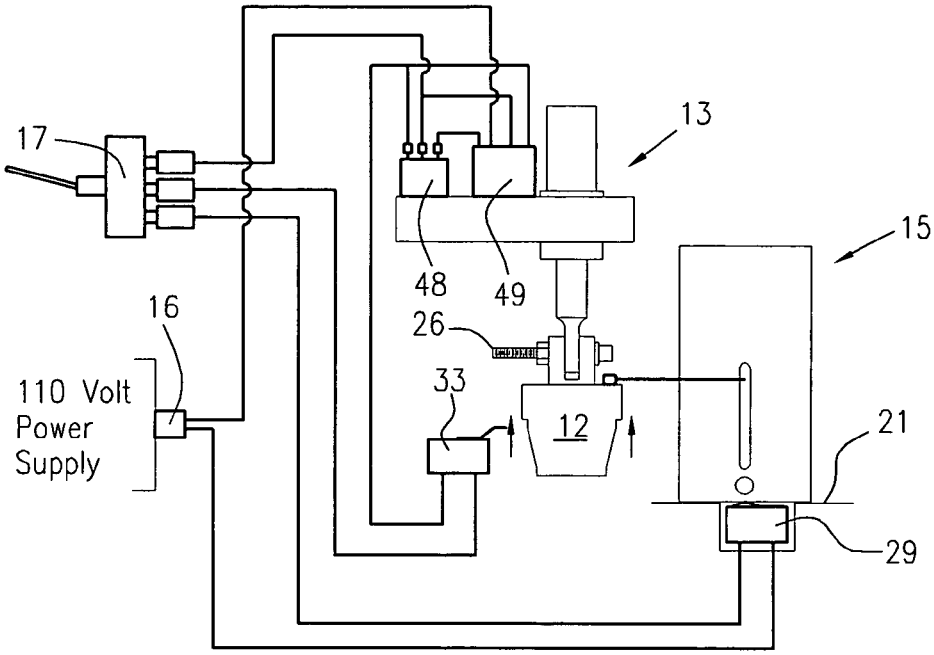
FIG. 8*d* is a schematic drawing illustrating the electrical circuit of a present invention pill crusher of FIG. 1, showing limit switch in a downward position and limit switch in an upward position; and, FIG. 8*e* is a schematic drawing illustrating the electrical circuit of a present invention pill crusher of FIG. 1, showing limit switch in an upward position and limit switch in an upward position.

FIG. 8*d* is a schematic drawing illustrating the electrical circuit of present invention pill crusher 10 of FIG. 1, showing limit switch 29 in a downward position and limit switch 33 in an upward position. Having switch 29 in a downward position and switch 33 in an upward position keeps the circuit closed to allow current to flow through. After pills are crushed and ramming element 12 has automatically stopped via switch 33, on/off switch 17 is pressed upward and linear actuator 13 actuates ramming element 12 in an upward direction.

Figure 8E:
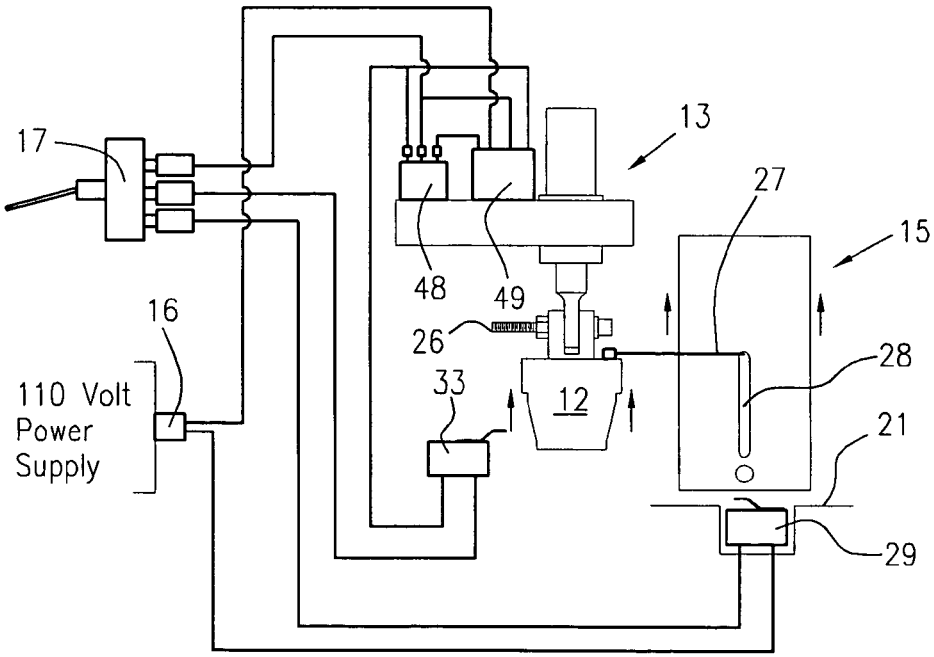

FIG. 8*e* is a schematic drawing illustrating the electrical circuit of present invention pill crusher 10 of FIG. 1, showing limit switch 29 in an upward position and limit switch 33 in an upward position. As on/off switch 17 is pressed upward, ramming element 12 is actuated upwardly until pin 27, matingly engaging slot 28 of access door 15, reaches the top of slot 28, such that door 15 is upwardly lifted. When door 15 is lifted upwardly, limit switch 29 is no longer pressed down by access door, and the circuit then opens. Thus, there is no current flowing through the circuit and ramming element 12 coupled to linear actuator 13 is automatically stopped via switch 29. This prevents linear actuator 13 from pulling ramming element 12 past a predetermined highest position. By "predetermined highest position," it is meant that ramming element cannot proceed further upward.

Thus, it is seen that the objects of the present invention are efficiently obtained, although modifications and changes to the invention should be readily apparent to those having ordinary skill in the art, and these modifications are intended to be within the spirit and the scope of the invention as claimed.

What is claimed is:

1. An automated pill crusher comprising:

a container operatively arranged to hold at least one pill;

a ramming element a linear actuator, including a worm gear, arranged to rotate the worm gear to propel the ramming element to produce a linear force and a rotational force to urge the ramming element upon said at least one pill in said container, said linear force in a first direction; and means for producing a spring force in a second direction upon said at least one pill in said container.

2. The automated pill crusher of claim 1 wherein said means for producing said spring force comprises a spring mechanism operatively arranged in said container.

3. The automated pill crusher of claim 1 wherein said container is operatively arranged to hold a first inverted frusto-conical shaped cup.

4. The automated pill crusher of claim 3 wherein said container is operatively arranged to hold a second inverted frusto-conical shaped cup, said second cup is operatively arranged to fit inside said first cup.

5. The automated pill crusher of claim 4 wherein said ramming element is operatively arranged to fit inside said first and second inverted frusto-conical shaped cups.

6. The automated pill crusher of claim 1 wherein said ramming element comprises a frusto-conical shape.

7. The automated pill crusher of claim 1 wherein said pill crusher further comprises a pulverizing attachment operatively arranged to crush pills.

8. The automated pill crusher of claim 7 wherein said pulverizing attachment further comprises a plurality of pyramids and a plurality of first ridges, disposed parallel to one another, extending in a first direction, and a plurality of second ridges, disposed parallel to one another, and extending in a second direction perpendicular to said first direction.

9. An automated pill crusher comprising:

a container operatively arranged to hold at least one pill;

an actuator, including a worm gear, arranged to rotate the worm gear to produce a linear force in a first direction upon said at least one pill in said container and arranged to produce a rotational force upon said at least one pill;

means for producing a spring force in a second direction upon said at least one pill in said container; and a pulverizing element arranged to pulverize said at least one pill in said container.

10. An automated pill crusher comprising:

a container operatively arranged to hold at least one pill;

an actuator, including a worm gear, arranged to rotate the worm gear to produce a linear force in a first direction upon said at least one pill in said container and arranged to produce a rotational force upon said at least one pill;

a pulverizing element arranged to pulverize said at least one pill in said container.

11. The automated pill crusher of claim 10 further comprises an access door and a first switch wherein said access door is operatively arranged to engage said first switch.

12. The automated pill crusher of claim 11 further comprising a ramming element. an arm fixedly secured to said ramming element, a second switch, and a guide track, wherein said second switch is operatively positioned at the end of said guide track and wherein said arm engages said second switch when said ramming element has reached a predetermined position.

* * * * *